US008448364B2

(12) United States Patent
Davidson

(10) Patent No.: US 8,448,364 B2
(45) Date of Patent: May 28, 2013

(54) DOUBLE STACK BOX MAGAZINE FOR RIMMED CARTRIDGES OF VARYING LENGTH

(76) Inventor: Michael J. Davidson, Casstown, OH (US)

( * ) Notice: Subject to any disclaimer, the term of this patent is extended or adjusted under 35 U.S.C. 154(b) by 98 days.

(21) Appl. No.: 13/234,714

(22) Filed: Sep. 16, 2011

(65) Prior Publication Data

US 2012/0066950 A1 Mar. 22, 2012

Related U.S. Application Data

(60) Provisional application No. 61/383,848, filed on Sep. 17, 2010.

(51) Int. Cl.
*F41A 9/65* (2006.01)

(52) U.S. Cl.
USPC ..... 42/50

(58) Field of Classification Search
USPC ..... 42/17, 18, 21, 22, 49.01, 49.02, 50
See application file for complete search history.

(56) References Cited

U.S. PATENT DOCUMENTS 465,339 A * 12/1891 Browning ..... 42/18
3,345,771 A 10/1967 Silsby
4,589,218 A 5/1986 Teppa
4,672,760 A 6/1987 Chesnut et al.
4,777,752 A 10/1988 Howard
4,790,094 A 12/1988 Chesnut et al.
4,805,333 A * 2/1989 Doria et al. ..... 42/50
4,862,620 A 9/1989 Chesnut et al.
4,864,758 A * 9/1989 Crossman ..... 42/18
5,014,456 A * 5/1991 Kurtz et al. ..... 42/50
5,056,252 A * 10/1991 Velezis ..... 42/50
5,099,595 A 3/1992 Chesnut et al.
5,127,178 A 7/1992 Sinclair
5,235,769 A 8/1993 Stead et al.
5,367,810 A 11/1994 Stead et al.
5,375,359 A 12/1994 Chesnut et al.
5,755,052 A 5/1998 Keeney

FOREIGN PATENT DOCUMENTS

GB 2446007 A * 7/2008

* cited by examiner

*Primary Examiner* — Gabriel Klein
(74) *Attorney, Agent, or Firm* — Wood, Herron & Evans, LLP

(57) ABSTRACT

Disclosed is a double stack box magazine for rimmed ammunition cartridges of varied lengths. It includes a housing having a neck portion in which cartridges are arranged in a single column, a double-stack portion in which cartridges are arranged in laterally alternating columns, and a transition portion between the neck portion and the double-stack portion. A pair of rim clearance channels is provided, on opposed interior lateral surfaces of the housing. A first channel portion allows clearance for cartridge rims without respect to forward and rearward position of the cartridges within the housing, which may vary depending on individual cartridge length. A second channel portion in the neck provides an abutment against which laterally opposed areas of a cartridge rim bear to shift the cartridge to a rearward position. A third channel portion provides transition between the first and second channel portions.

6 Claims, 12 Drawing Sheets

DOUBLE STACK BOX MAGAZINE FOR RIMMED CARTRIDGES OF VARYING LENGTH

RELATED APPLICATION

This application claims priority to my U.S. Provisional Patent Application No. 61/383,848 filed Sep. 17, 2010 entitled Double Stack Box Magazine for Shotgun Cartridges.

TECHNICAL FIELD

This application relates to box-type ammunition magazines, particularly to detachable multiple column (double stack) magazines for rimmed cartridges.

BACKGROUND

Typically, ammunition magazines for firearms fall into two broad categories: fixed and detachable. Box magazines may fall into either of these categories.

Rimmed cartridges present certain challenges for designing and manufacturing reliable ammunition feeding devices, particularly for higher capacity box magazines, not encountered with rimless cartridges. The most popular types of rimmed ammunition include shotgun shells and rimfire cartridges, the latter being used in rifles and pistols.

Unlike rifle and pistol ammunition which has a very consistent standardization in length of a live cartridge from most manufacturers and/or loads, shotgun ammunition typically has significant variations in live cartridge length from one manufacturer and/or load to the next. The spectrum of length variation for rifle and pistol ammunition can typically be measured in the hundredths of an inch (0.0X0") if not the thousands of an inch (0.00X"). The spectrum of shotgun ammunition can in some cases be measured at over an inch (X.00") of length difference from one manufacture to the next. And more typical in the tenths of an inch (0.X00").

Manufacturers typically call out shotgun ammunition in ¼ inch (0.25") or ½ inch (0.5") increments, for example, 2¾", 3", and 3½". Typically, if a rifle or pistol cartridge has this much difference in length, it becomes a totally different round. For example; 9 mm Luger vs. .380 Auto, .45 Auto vs. .45 GAP, .22 Magnum vs. .22 Long Rifle vs. .22 Short, 8 mm Mauser (7.92×57) vs. 7.92×33 Kurz. Different shotgun models can typically fire everything it is chambered to (in a particular gauge) and all cartridges of shorter length. For example, the typical 12 ga shotgun that is chambered in 3" can fire both 3" and 2¾" cartridges. The typical rifle or pistol model cannot do this safely and/or reliably, the few exceptions not being relevant to this discussion.

Although shotgun cartridges are typically called out in nominal ¼ inch length increments, they still greatly vary from one manufacturer and/or load to the next. Typically, the length call out is the length of the empty casing or hull. Typically, when it is loaded it loses length from crimping or rolling the casing/hull. Depending on the manufacturer and/or load, a live 2¾" cartridge can measure less than 2.25" in length or it can measure more than 2.55" in length.

Another difference is that the typical shotgun ammunition is a rimmed cartridge. Most pistol and rifle ammunition has evolved into a rimless cartridge, the exceptions, again, not being relevant to this discussion. The feeding of a double stack of rimless rifle or pistol cartridges in a box magazine does not typically encounter the problem of misaligned rims.

Box magazines achieve reliability by repeatability. A typical box magazine fed weapon uses an ammunition cartridge that is very consistent in length. This prevents front to back movement and misalignment of the cartridges in the magazine under forceful movement or recoil of firing the weapon. Magazine fed weapons have an optimal position of the next cartridge to load from the top of the magazine. For example, if the cartridge is not contained or restrained to prevent longitudinal (forward and aft) movement, the round can be positioned too far forward in the magazine as it is presented for chambering, causing misalignment, or can prematurely extract from the magazine. This results in a high probability of jamming during chambering of the cartridge. For typical shotgun cartridges, it can also allow the rim of a cartridge below the top cartridge to bind the rim of the top cartridge and cause a jam (failure to feed).

A box magazine for a shotgun presents a greater challenge because of the rim and shotgun cartridges' wide range of loaded length. For this reason, there are very few box magazine fed shotguns. In the past, box magazines for shotguns have addressed this issue in only two ways, both of which include an upwardly angled stack provided by the follower. Either the cartridge was contained by holding the cartridge by its rim for the length of the magazine, preventing longitudinal movement (particularly forward movement of lower cartridges) and misalignment of cartridges and their rims. Or, it has restrained longitudinal movement (and resulting misalignment) by walls that bear against the head and forward end of the cartridge. This latter solution eliminates the use of all cartridges other than a very small portion of the spectrum of cartridge lengths. This includes many cartridges of the same nominal (call out) length. For example, not all 2¾" cartridges would fit and/or feed reliably with this method. This is not very feasible considering the wide range of lengths of shotgun cartridges. Moreover, the shooter who is very accustomed to the versatility in the typical shotgun model to except these different lengths of cartridges does not find this acceptable.

Putting two columns of rimmed shotgun cartridges side by side makes it impossible to contain the cartridges by holding their rims in alignment. The side of the rim toward the transverse center width of the magazine (inboard side) meets the column of cartridges beside it and cannot be contained. Therefore, longitudinal movement (particularly forward movement of a lower cartridge) and misalignment and binding of rims are possible—and likely.

SUMMARY OF THE INVENTION

The present invention provides a new and better way of addressing this problem. A double stack box magazine may taper to a single stack feed at the top. In the double-stack portion, the rounds are allowed to shift forward and rearward without regard to head or rim position. Once single stack geometry is met, an angled surface on the inside of the magazine body catches both sides of the rim of the cartridge and pulls it back to the rear of the magazine, allowing proper alignment and preventing the rims from binding during feed.

This allows a very large variation of cartridge lengths, both within or beyond the same nominal length, to be fed reliably from the same magazine. That is, not only can cartridges of varying actual lengths within the same nominal size (such as 2¾") due to variation in manufacturer and/or load be mixed in the same magazine, cartridges of different nominal length (length call out, such as 3") can be mixed in the same magazine (such as 2¾" and 3", up to the maximum chamber length of the shotgun) without loss of feed reliability. Because only one side of a cartridge rim at a time can engage a slot or groove on the inside surface of the magazine body when the shells are in alternating columns, if the front-to-rear dimension of the magazine body is sized to accept shells of varying lengths, the rims cannot reliably be held in alignment against the recoil forces of firing the shotgun or other vibration, sudden movement, or impact. The interior angled surface guides the rim of the uppermost cartridges to the rear, no matter how the shell has become situated during its travel up the magazine body, and places the rim of upper cartridges in front of the rim of the next cartridge below it.

Alternatively, an insert can be used to take up the excess opening in the front of the magazine. This is less desirable because many different thicknesses of inserts would be needed to meet the same length capabilities as the primary. The followers would have to be switched out along with the inserts to account for the front to back shortening and lengthening of the magazines' interior. This would also sacrifice the ability to load 2¾" and 3" shotgun shells in the same magazine and would be less convenient or likely would not be well accepted by the shooter to have to swap out parts in the magazine.

Another feature of the present design is a follower that is guided in front and rear (rather than lateral) tracks. This allows for a short, one-piece follower that maintains a consistent location as well as consistent force. A one-piece side tilting follower design, like used in many double stack pistol magazines, is possible, but does not offer the same consistency. Any inconsistencies can make jamming more likely. A side tilting design would have to tilt to the side as the follower transitioned between the single and double stack portions of the magazine, while at the same time maintaining the location and angle of the shells resting against the changing angles of the follower.

BRIEF DESCRIPTION OF THE DRAWINGS

Like reference numerals are used to indicate like parts throughout the various figures of the drawing, wherein.

DETAILED DESCRIPTION

Figure 1:
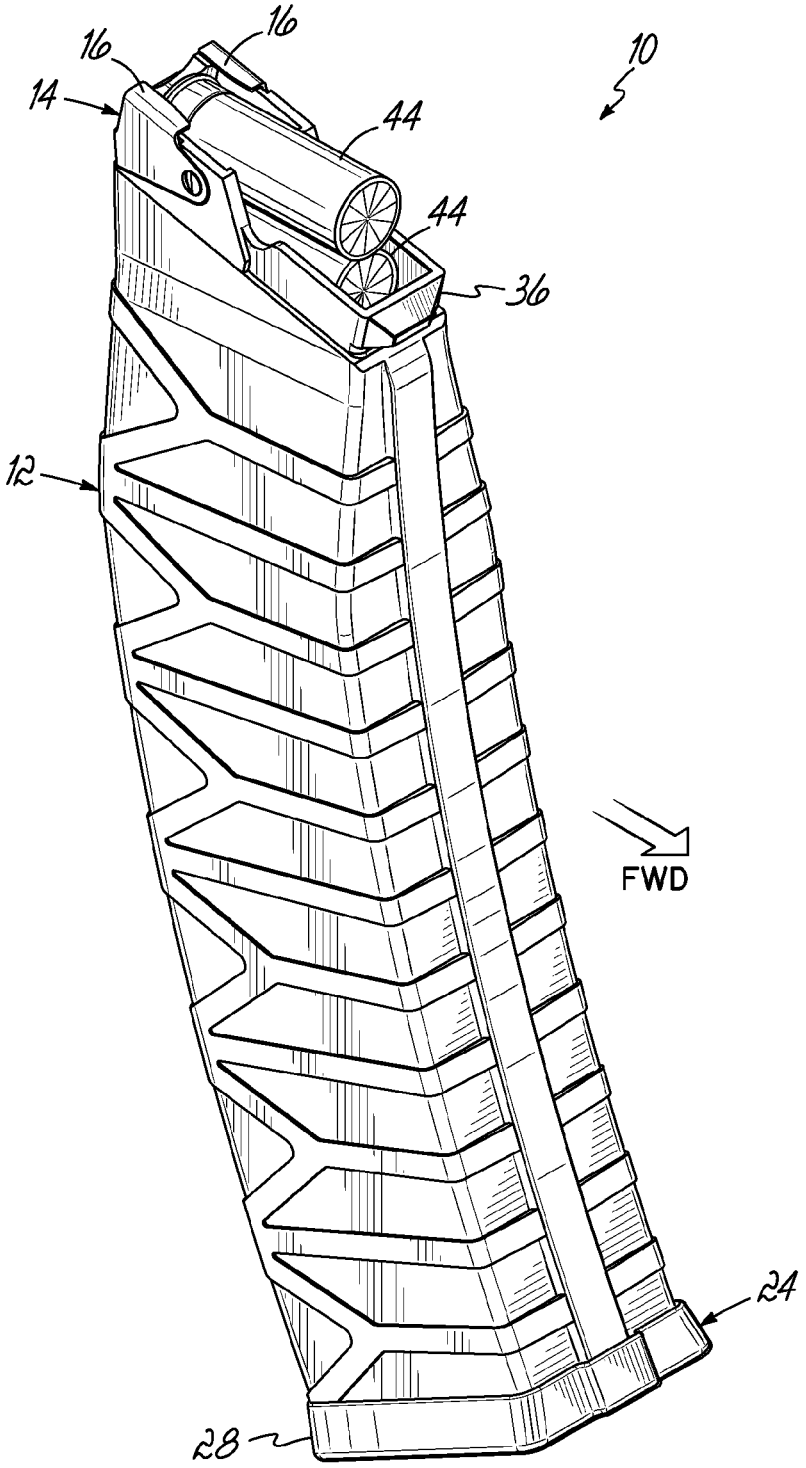
FIG. 1 is a pictorial view of a double-stack detachable box magazine for shotgun cartridges according to a preferred embodiment of the present invention.
Figure 2:
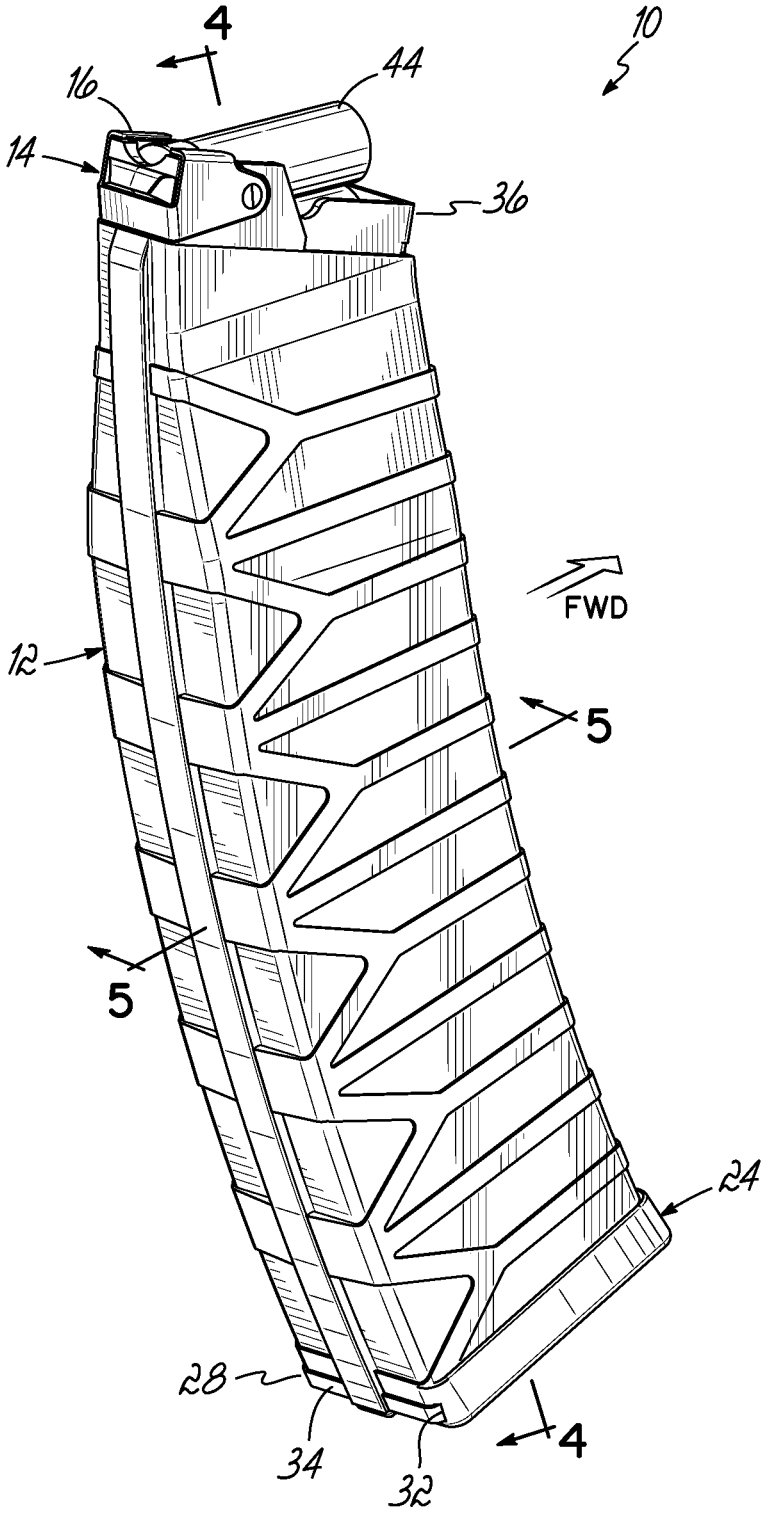
FIG. 2 is a pictorial view of the magazine shown in FIG. 1 from an alternate angle.
Figure 3:
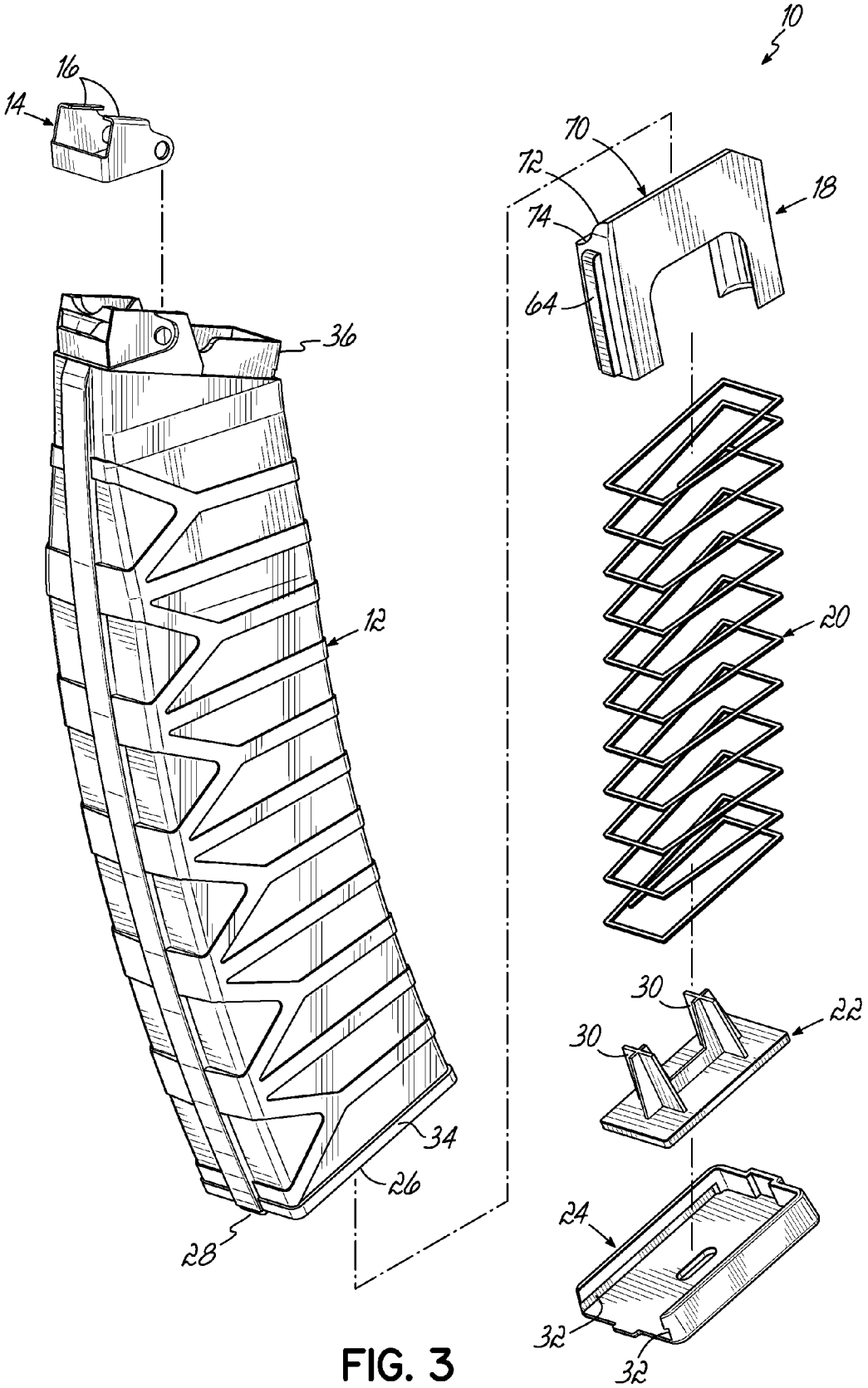
FIG. 3 is a pictorial exploded view thereof.

Referring to the various figures of the drawing and first to FIGS. 1 and 2, therein is shown at 10 a magazine according to a preferred embodiment of the present invention. Referring now also to FIG. 3, which is an exploded view of the various parts of the magazine 10, it includes a magazine body 12, a attached metallic member 14, which provides feed lips 16 and snaps in place at an upper end of the magazine body 12. Also shown is a follower 18, a coil compression spring 20, a floor plate guide 22, and a floor plate 24. As is standard with any box magazine, it is assembled by inserting the follower 18 through an opening 26 at a bottom end 28 of the magazine body 12.

A coil spring 20 is inserted through the bottom opening 26 behind or along with the follower 18. The spring 20 may have a rectangular shape (as shown), may be a cylindrical coil (not shown), or a combination of both, and its width or diameter may be tapered in cross-section along its length. In the present invention, it has been found useful to have a floor plate guide 22 with protrusions 30 or other means for holding the spring 20 in a properly centered position at the lower end. The floor plate guide 22 is inserted into the bottom opening 26 behind or along with the spring 20 and then the floor plate 24 is slid into a closed position by engaging the lateral grooves 32 on lateral rails 34, which are adjacent the bottom opening 26 of the magazine body 12.

For purposes of illustration only, the magazine 10 shown and described herein is adapted to fit a Kalashnikov-pattern Saiga 12 semi-automatic shotgun, manufactured in Russia by Izhmash. Accordingly, the upper end 36 of the magazine body 12 is configured to properly engage a detachable coupling with a magazine well in such a shotgun (not shown). Accordingly, the illustrated embodiment includes a attached metallic member 14 that snaps in place adjacent the upper end 36 of the magazine body 12 to provide durable feed lips 16 in accordance with the existing designs found in a single-stack, smaller capacity box magazine for such a shotgun. Alternatively, feed lips may be provided integrally with the magazine body 12 either from the same material or by encapsulating/over-molding a metallic member.

Figure 4:
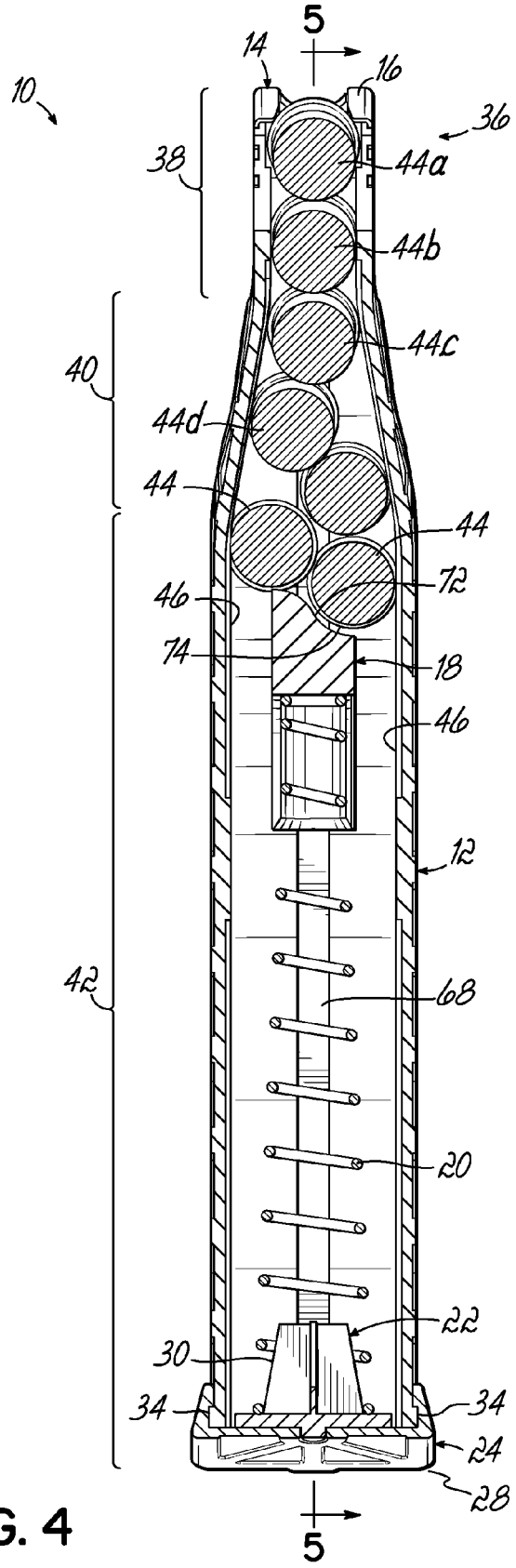
FIG. 4 is a sectional view taken substantially along line 4-4 of FIG. 2.

Referring now to FIG. 4, which shows a vertical sectional view of the magazine 10, it can be seen that the magazine body 12 has three distinct regions: an upper or neck portion 38; a transition portion 40; and a widened double-stack portion 42. The upper or neck portion 38 at the upper end 36 of the magazine body 12 is dimensioned as a single-stack magazine to fit within the magazine well of the shotgun. The standard magazine well of currently-available semi-automatic shotguns cannot accept the added width of a double-stack magazine body. In the prior art, the need for this narrowed neck portion has presented a challenge in that the same follower must move a double row of cartridges along the wider double-stack portion and then completely push all cartridges through a transition to a narrow neck and fully into a delivery position. In the past, this problem has been addressed by either using a follower of exaggerated length, which consumes a greater portion of the magazine's length, or using hinged follower arms that displace into a more narrow profile as they enter the neck portion of the magazine, creating a complex and expensive-to-construct design. The present invention addresses this issue differently, as will be more fully explained below.

As discussed in the background section above, reliably feeding shotgun shells in a box magazine presents challenges not found in handling rifle and pistol cartridges. Generally, a shotgun is expected to be able to handle and fire shells of the specified chamber length or shorter. Moreover, shells of any standard nominal length may vary considerably in actual length. Prior art box magazines rely on the length of each cartridge being substantially identical, within a very small acceptable tolerance and/or use of a significantly angled follower. Also as described above, prior single-stack box magazines for shotgun shells address this challenge by engaging the rim of each cartridge on both sides within a narrow track or groove that maintained rims of subsequent cartridges in an "ordered" position and use a significantly angled follower to prevent binding caused by frontward/rearward shift to provide reliable feeding into a position to be stripped away by the shotgun's reciprocating bolt.

Figure 5:
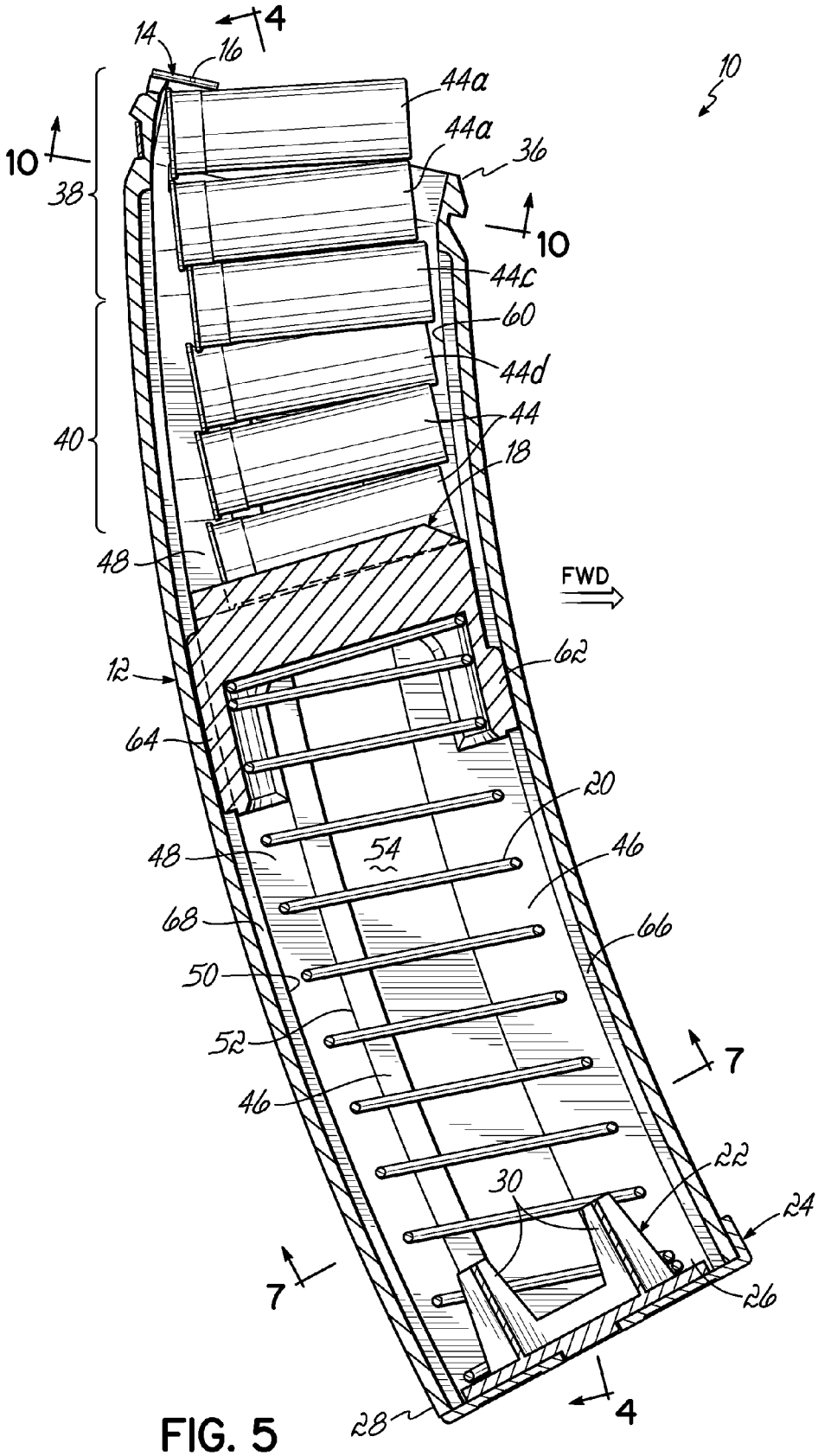
FIG. 5 is a lateral sectional view taken substantially along line 5-5 of FIGS. 2 and 4.
Figure 6:
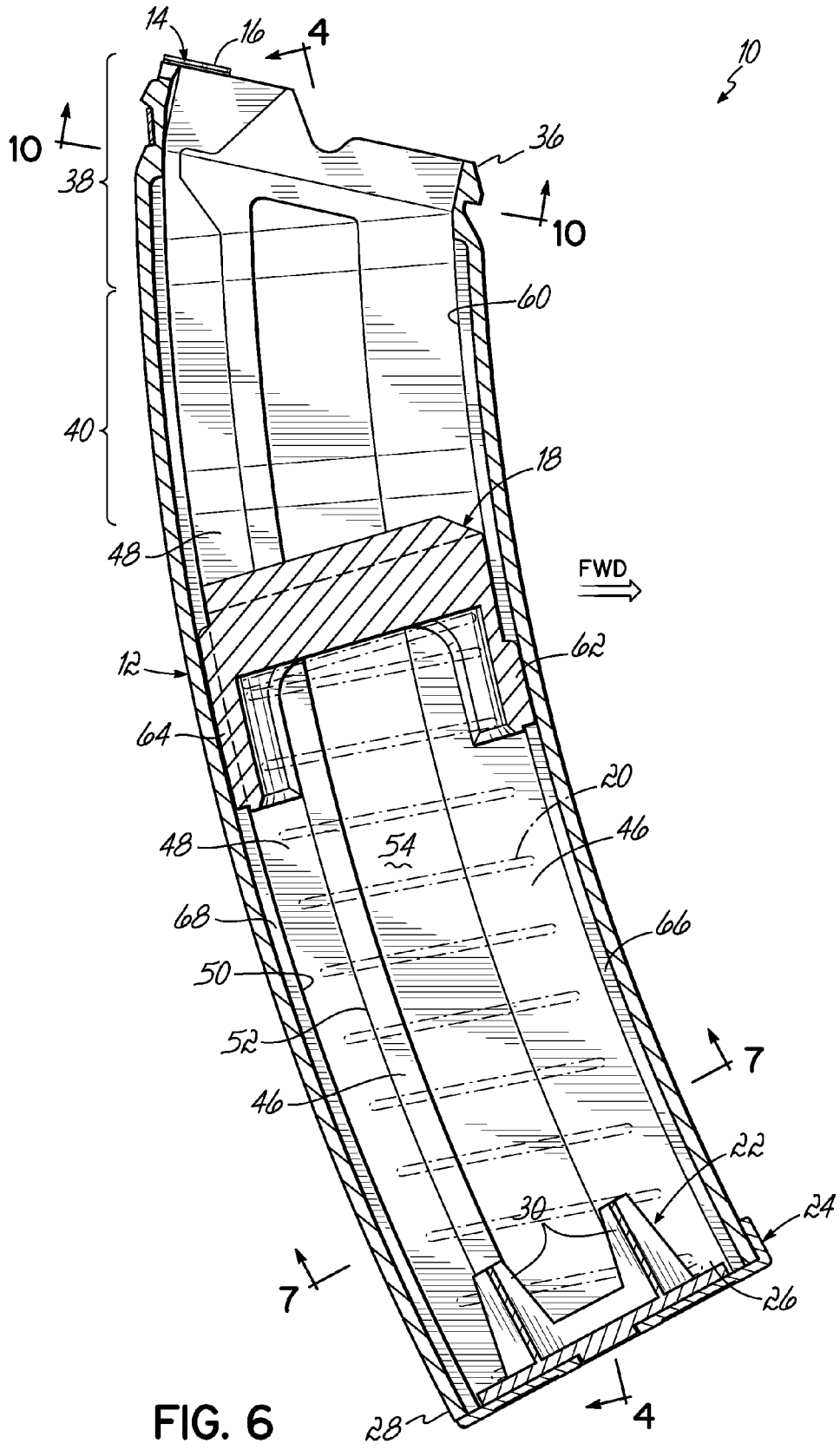
FIG. 6 is a view identical to that of FIG. 5 except that the ammunition cartridges and spring have been removed for clarity.

Referring now to FIGS. 5 and 6, therein are shown sectional views taken substantially along the lateral longitudinal center of the magazine 10. FIG. 5 shows the magazine 10 partially loaded with shotgun shells 44, which are also sectioned in this view. FIG. 6 is substantially the same as FIG. 5, except that the shotgun shells 44 have been removed from the view, along with the spring 20 for clarity. The follower 18 is shown in the same position in each view, however. These views show the lateral interior surface 46 of the magazine body 12. The opposed lateral surface (not shown in these views) is configured identically in a mirror image. Alternatively, the position of certain components can be vertically offset in one side relative to the other in order the balance the handling of the staggered double columns of shells 44.

Adjacent the rear edge of the magazine body 12 is a relatively wide rim clearance channel 48. A rear edge 50 of the channel 48 is defined along the rearward interior surface of the magazine body 12. A forward edge 52 of the channel 48 is defined by the lateral interior surface 46. In preferred form, however, the forward edge 52 is positioned to accommodate even the shortest nominal or actual length shotgun shells 44 without confronting the rim.

Figure 7:
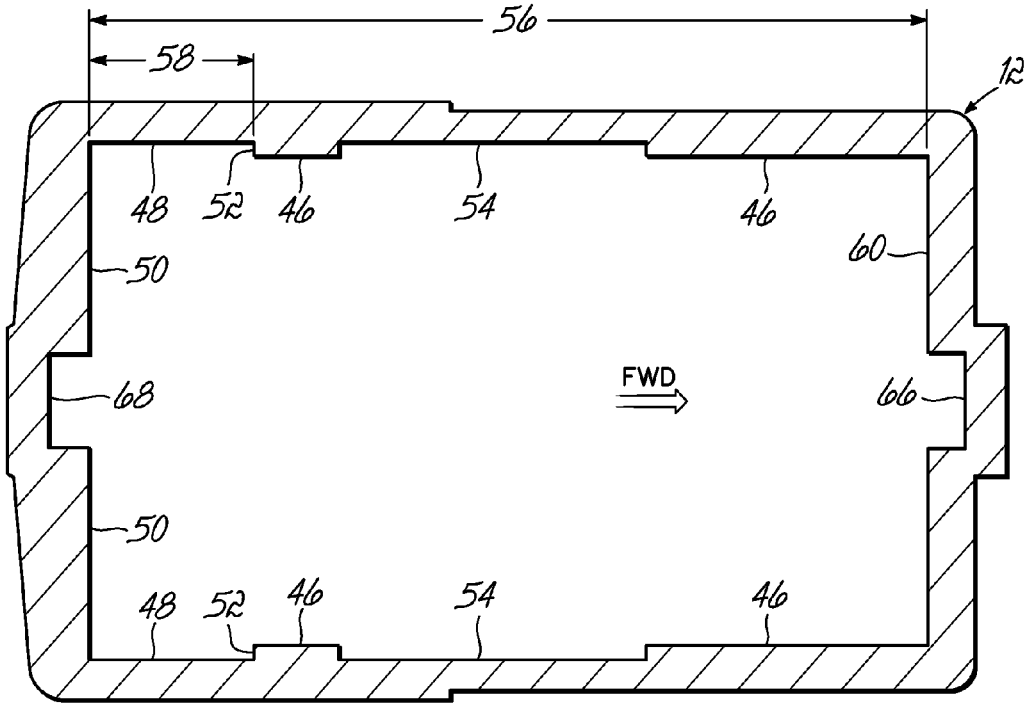
FIG. 7 is a cross-sectional view taken substantially along the line 7-7 of FIGS. 5 and 6.

FIG. 7 shows a cross-sectional view taken substantially along line 7-7 of FIGS. 5 and 6, and illustrates the relative lateral depth of the rim clearance channel 48 and lateral interior surfaces 46. If desired, the lateral interior surface 46 may be inlet with a recessed area 54 in order to reduce material and weight from the magazine body 12 and/or to reduce frictional surface area between the interior surface 46 and the shells 44. If such a recessed area 54 is included, adjacent portions of the lateral interior surface 46 on each side of the magazine body 12 should be maintained in substantially the same plane in order to smoothly guide the bodies of shotgun cartridges or shells 44 as they slide along the length of the magazine 10. The recessed area 54 can be configured to act as an additional follower guide when the follower 18 is in the upper portion 38 of the magazine body 12 or to provide an alternate follower stop. Alternatively, the recessed area 54 can be configured to function as a guide for round spring (not shown).

The overall front-to-rear interior dimension 56 should be configured to accept the longest expected overall length of a shotgun cartridge 44 to be used in the magazine 10 and its associated shotgun (not shown). The front-to-rear dimension 58 of the rim guide channel 48 optimally may be selected such that the rim of a shotgun shell of the shortest expected overall length will remain between rear and forward edges 50, 52 of the clearance channel 48 when a shell is shifted forward to the point of being against or near the forward interior surface 60 of the magazine body 12.

It can be appreciated by comparison of the views in FIGS. 4 and 7 that while in the double-stack portion 42 of the magazine body 12, the alternating rows of shotgun shells 44 have their respective rims engaged in only one of the laterally opposed rim guide channels 48. Because only a very minor portion of the cartridge rim could be engaged in the clearance channel 48 in the double-stacked portion 42 of the magazine 10, it has been found that the rearward shock forces to which an attached magazine 10 is subjected when the shotgun is fired (or even when dropped or otherwise impacted) is likely to jar the cartridges 44 out of a narrow guide channel until the cartridge comes to rest against the forward interior surface of the magazine. Thus, the present design allows this inevitable movement to occur, while maintaining containment of a rim portion of each cartridge 44 in one of the relatively wide rim clearance channels 48.

The follower 18 has forward and rearward guide rails 62, 64, which engage forward and rearward follower guide channels 66, 68 on interior front and rear surfaces 60, 50 of the magazine body 12. The follower guide rails 62, 64 have sufficient vertical length to prevent lateral tipping of the follower 18 as it travels along the length of the magazine body 12. The forward follower guide rail 62 is shorter in vertical dimension than the rear follower guide rail 64 in the illustrated design to accommodate the curvature of the magazine body 12 and the position of a front magazine catch at the upper end 36 of the magazine 10.

Figure 8:
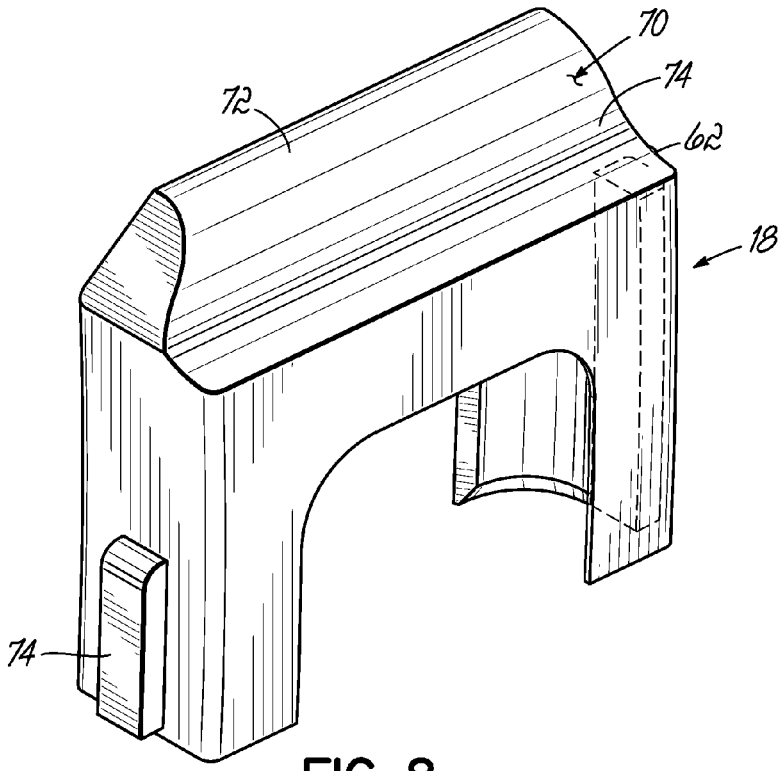
FIG. 8 is a pictorial view of the follower.

As best illustrated in FIGS. 4 and 8, the upper surface 70 of the follower 18 may be, for example, divided laterally into a raised convex portion 72 and a lower concave portion 74. The lower concave portion 74 cradles and guides a cartridge 44 against a lateral interior surface 46 of the magazine body 12. In combination, the upper convex portion 72 of the follower 18 and an adjacent cartridge 44 guides another cartridge 44 against the opposing lateral interior surface 46, maintaining portions of each cartridge rim in engagement with one of the rim guide channels 48 on each respective side. The height difference between the raised convex portion 72 and lower concave portion 74 maintains sequential cartridges 44 in a vertically staggered relationship, as well as their laterally staggered relationship. Other shapes for the upper surface of the follower 18 may be selected, as desired, in order to balance the resistance of both columns of cartridges 44.

As cartridges 44 are stripped away from the upper end 36 of the magazine 10, cartridges 44 situated lower in the magazine 10 are moved from the double-stacked portion 42 into the transition portion 40, where their relative vertical position increases as their relative lateral position decreases. This is best illustrated in FIG. 4.

As cartridges 44 continue to be moved upwardly, through the transition portion 40, they enter the upper or neck portion 38 of the magazine 10, in which the cartridges 44 become vertically aligned in a single column with opposing edges of their rims both engaged in both opposing rim clearance channels 48. In a preferred form, the vertical length of the neck portion 38 is kept to the minimum length necessary to engage the magazine well (not shown) of the selected shotgun, so that the combined transition portion 40 and double-stacked portion 42 of the magazine 10 may be maximized, thereby maximizing the capacity of the magazine 10.

Figure 9:
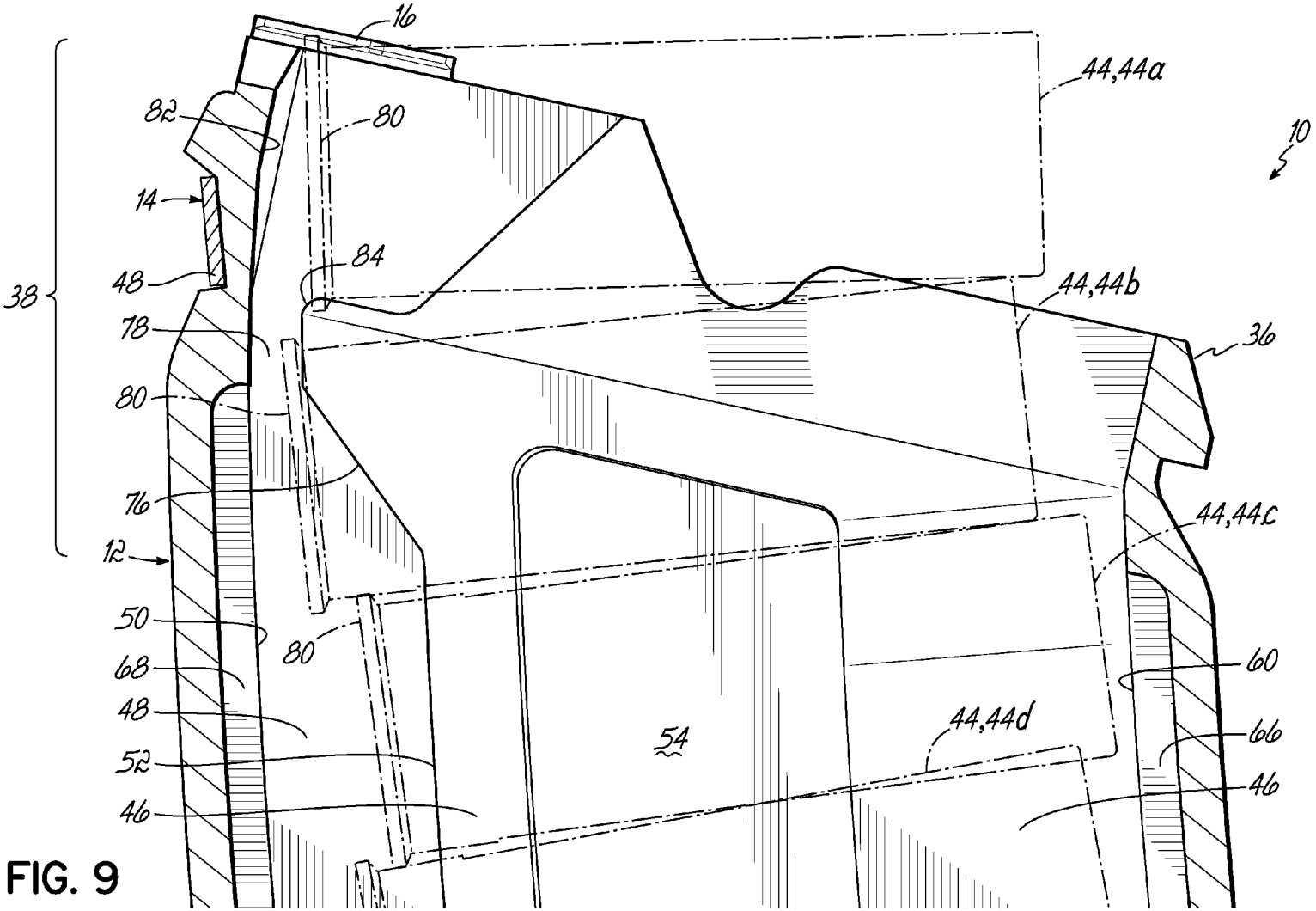
FIG. 9 is an enlarged view of the upper portion shown in FIG. 5.

Referring now in particular to FIG. 9, therein is shown an enlarged view of an upper portion of the magazine 10 seen in FIG. 5. The shotgun cartridges 44 are shown in phantom line in order to better view internal details of the magazine body 12 and are labeled individually as 44*a* through 44*d* for clarity of discussion. In or near the neck portion 38 of the magazine body 12, the rim clearance channels 48 narrow toward the rear edge 50. The forward edge 52 of the channel 48 ceases to be widely spaced from the rear edge 50 and presents an angled transition edge 76 which progressively decreases the width of the channel 48 toward a relatively narrowed rim guide channel 78. The angled transition edge 76 and narrowed rim guide channel 78 are situated within or near the neck portion 38, a region in which two opposite portions of cartridge rims 80 simultaneously engage both channels 48 on lateral interior walls of the magazine body 12.

As cartridges 44 are stripped from the upper end 36 of the magazine 10, cartridges at a lower position, such as that shown as 44*c*, migrate upwardly. As the rim 80 is engaged on both lateral sides, it is drawn rearwardly by the angled transition edge 76 to a position generally represented by cartridge 44*b*. At this point, even if the rims 80 of the cartridges 44 are "misaligned" as shown by 44*b* and 44*c* in FIG. 9, each cartridge 44 is moved rearwardly until the rim 80 is positioned in the narrow rim guide channel 78. As the cartridges 44 continue to progress upwardly, such as from the position of cartridge 44*b* to cartridge 44*a*, an upper portion of the rim 80 bears against a forwardly-sloped rear wall portion 82. This movement reorients the uppermost cartridge 44*a* relative to the cartridge 44*b* below it, and forces the rim 80 into appropriate alignment as it passes a shoulder 84 at an upper end of the narrowed rim guide channel 78. In this position, the rim 80 of the cartridge 44*a* is pressed against the feed lips 16 by spring pressure and is in position to be stripped away and chambered by the bolt of the firearm.

Figure 10:
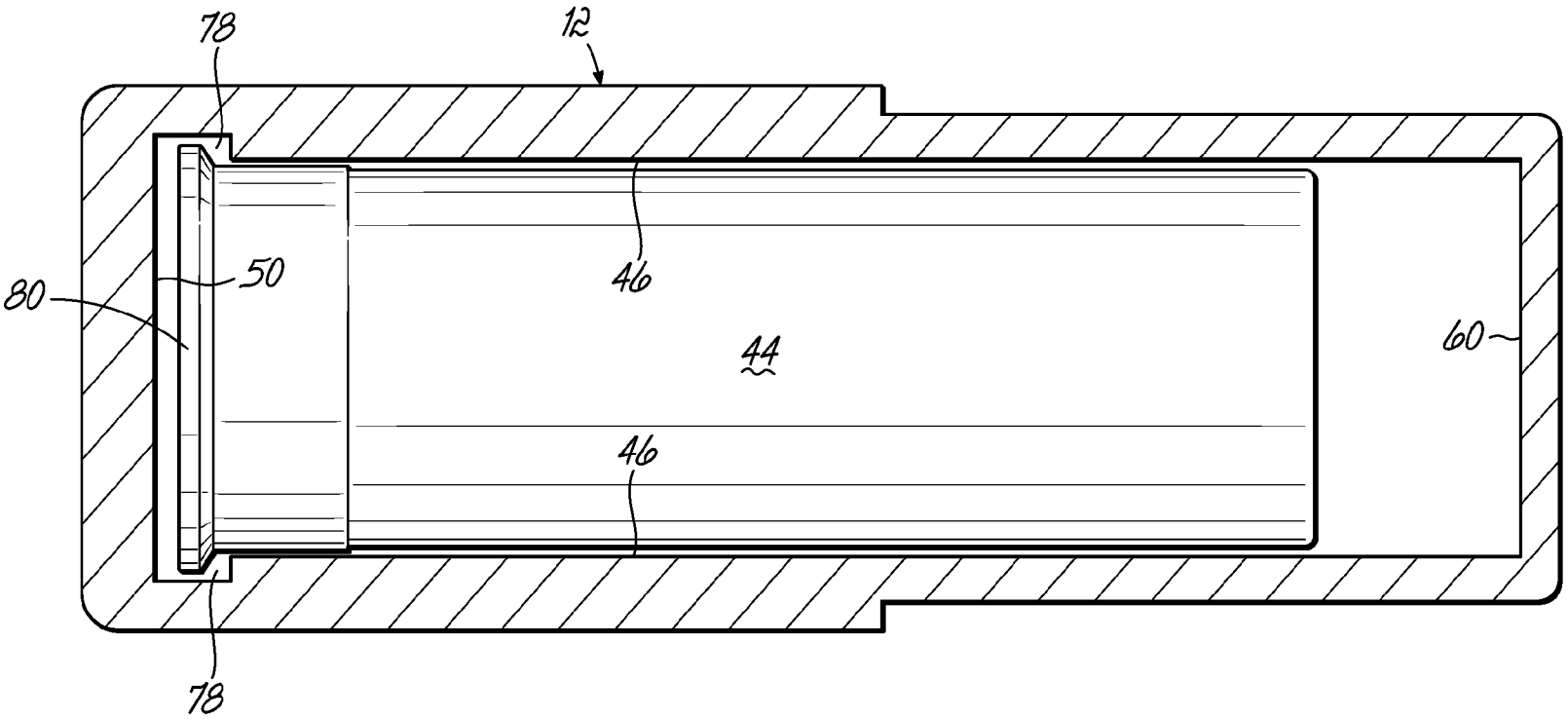
FIG. 10 is a cross-sectional view taken substantially along line 10-10 of FIGS. 5 and 6.

FIG. 10 shows a cross-sectional view taken substantially along line 10-10 of FIG. 6. Therein can be seen the relative position of the narrowed rim guide channel 78 and lateral interior surfaces 46 of the magazine body 12 in the neck portion 38 of the magazine body 12 where the rim 80 of a cartridge 44 is engaged on both sides adjacent the rear wall of the magazine body 12.

Figure 11:
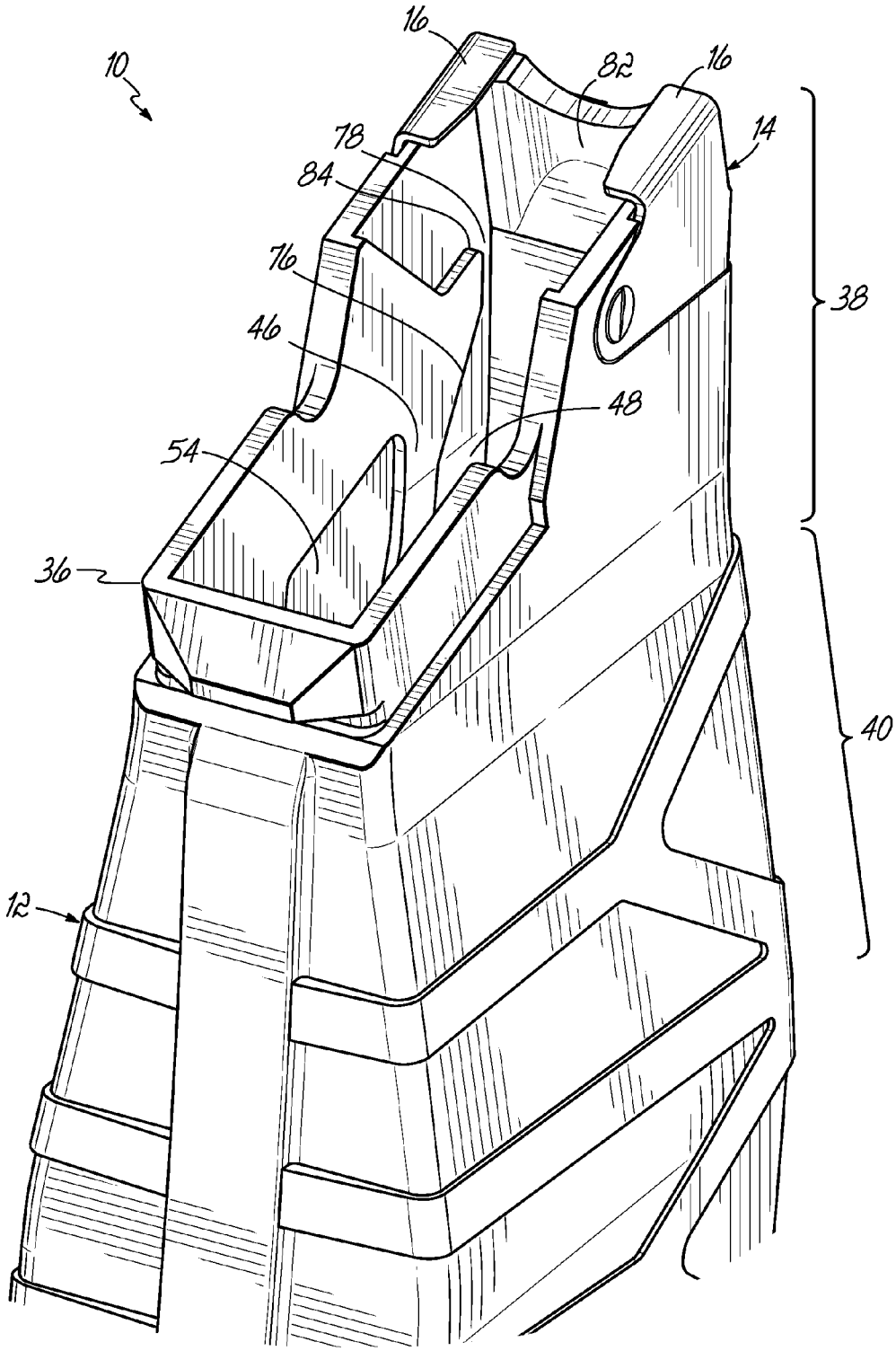
FIGS. 11-13 are sequential pictorial views of an upper end of the magazine showing sequential positions of ammunition cartridges being moved upwardly through the magazine body.
Figure 12:
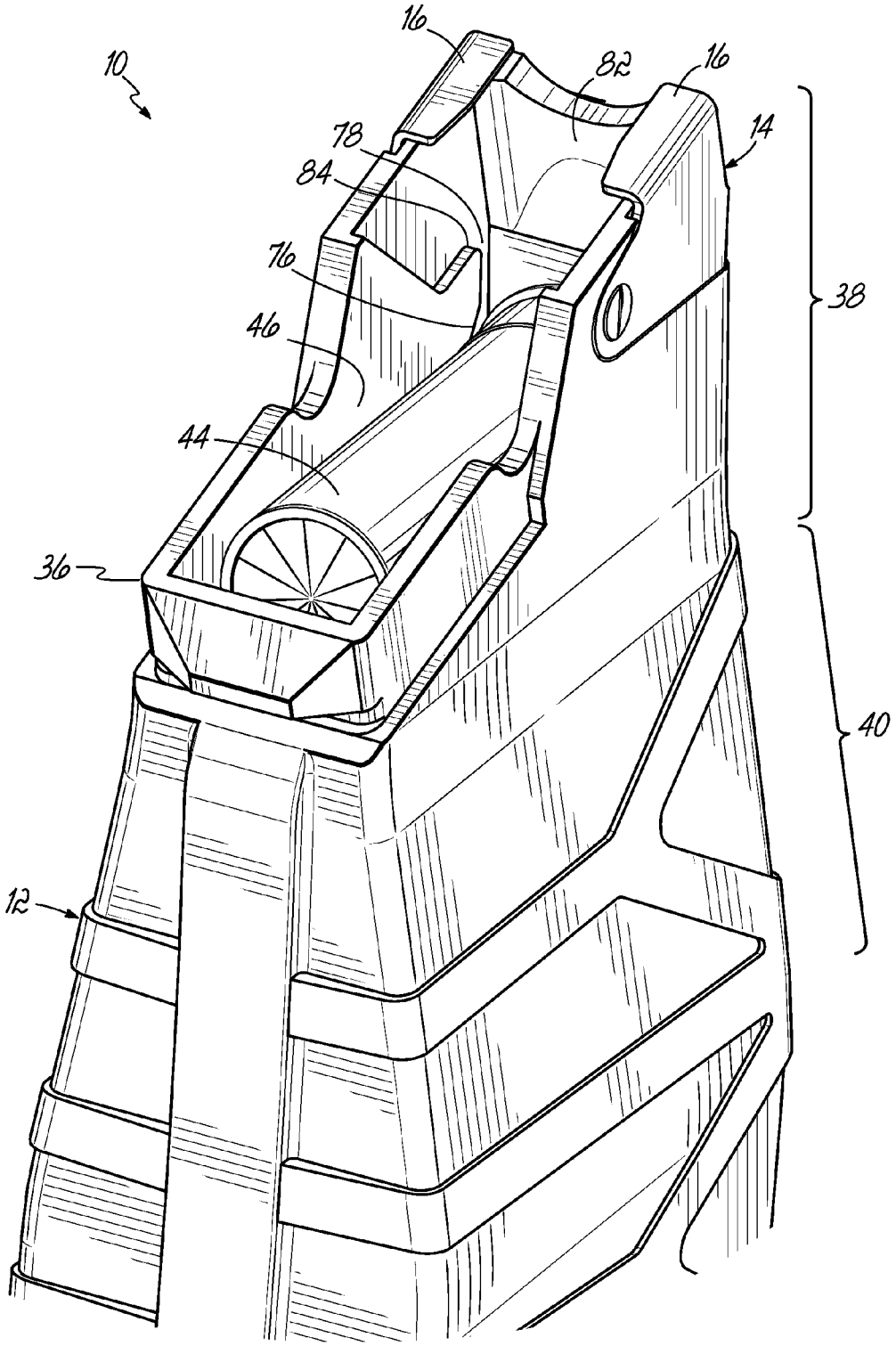
Figure 13:
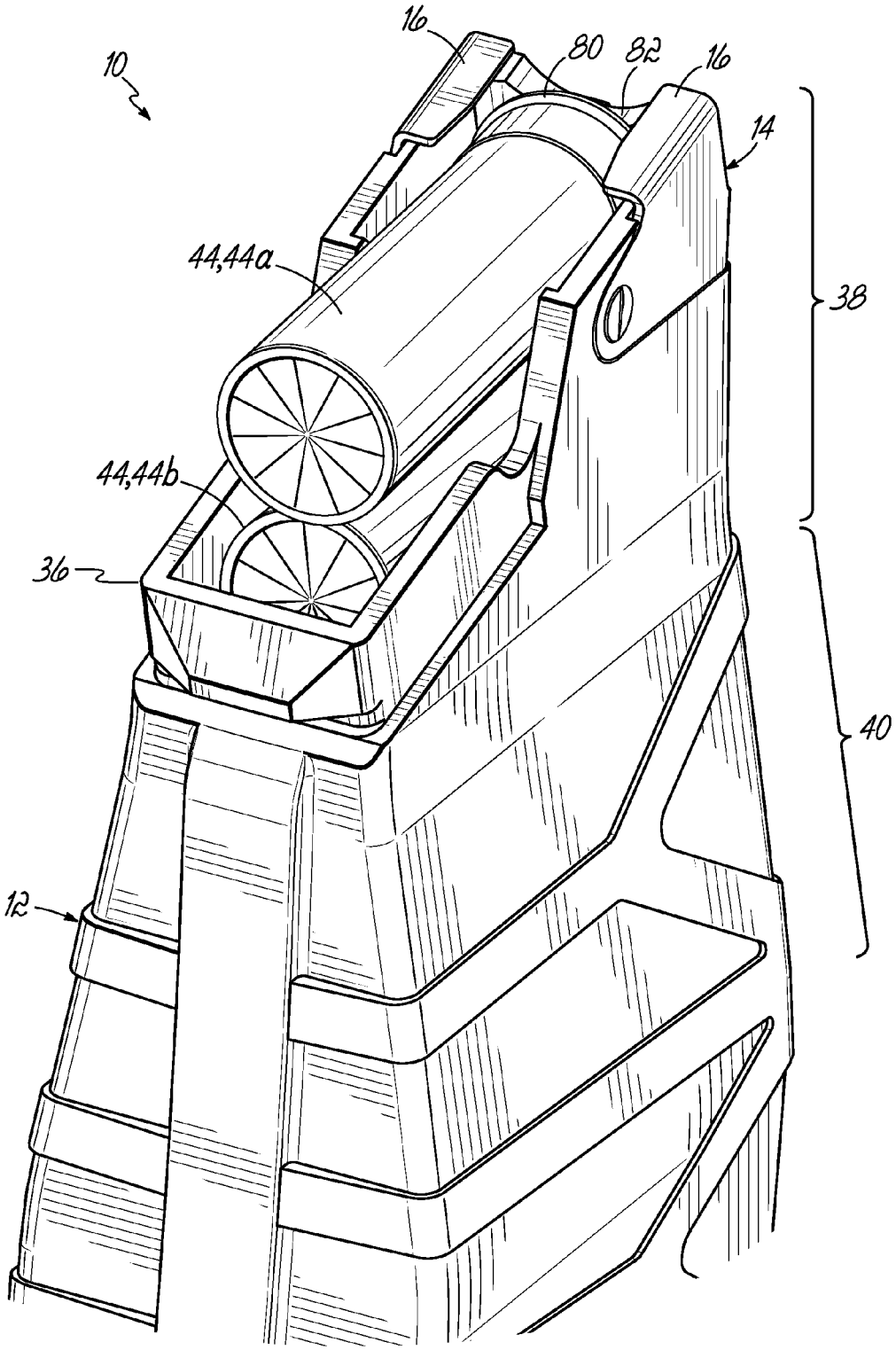

FIGS. 11-13 show sequential pictorial views of the upper end 36 of the magazine 10 as cartridges 44 are sequentially moved upward. The rim 80 of each cartridge 44 is moved along and engaged by the rim guide channels 48 on opposite lateral interior walls of the magazine body 12. As the rim 80 of each cartridge 44 encounters the angled transition edge 76, the rim 80 is pulled rearward into the narrowed rim guide channel 78. An upper edge of the cartridge rim 80 is guided by the forwardly-sloped rear wall portion 82 and pressed by spring force into position by the feed lips 16.

As used herein, "forward" or "front" refers to the muzzle or discharge end or direction of a firearm, distal from the user. "Rearward" or "rear" refers to end of the firearm proximal to the user and opposite the direction of a projectile discharge. "Up" or "upward" can, but does not necessarily, mean a vertically upward direction. Instead, these terms are meant to describe the direction of or movement toward the mouth or feed end of the magazine, even if a particular firearm utilizes a top or side loading magazine configuration or if the firearm may be mounted in different orientations.

The illustrated embodiment was chosen and described to provide the best disclosure of the principles of the invention and its practical application to thereby enable one of ordinary skill in the art to utilize the invention in various embodiments and with various modifications as are suited to the particular use contemplated. All such modifications and variations are within the scope of the invention as determined by any allowed claims when interpreted in accordance with the breadth to which they are fairly, legally and equitably entitled. The drawings and preferred embodiments do not and are not intended to limit the ordinary meaning of the claims and their fair and broad interpretation in any way.

What is claimed is:

1. A double stack box magazine for rimmed ammunition cartridges of varied lengths, comprising:

an elongated housing having a neck portion in which cartridges are arranged in a single column and having a mouth at an upper feed end through which cartridges are inserted and extracted, a double-stack portion in which cartridges are arranged in laterally alternating columns, and a transition portion between the neck portion and the double-stack portion in which the two alternating columns are transitioned into the single column as the cartridges are moved toward the mouth within the housing;

a follower configured to move along elongated guides in the housing;

a spring configured to bias the follower toward the mouth; and a pair of rim clearance channels, one on each of opposed interior lateral surfaces of the housing, the channels having a first channel portion in which a width of the channels allows clearance for cartridge rims without respect to forward and rearward position of the cartridges within the housing which varies depending on individual cartridge length, a second channel portion in the neck portion of the housing in which a forward edge of the channel provides an abutment against which laterally opposed areas of a cartridge rim bear to shift the cartridge to a rearward position within the housing as cartridges are moved toward the mouth, and a third channel portion providing transition between the first and second channel portions and having a rearwardly sloped forward edge which confronts laterally opposed areas of a cartridge rim as cartridges are moved upwardly within the housing to the neck portion.

2. The magazine of claim 1, wherein the housing is detachable from a firearm.

3. The magazine of claim 1, wherein the housing is forwardly curved.

4. The magazine of claim 1, wherein the elongated guides are configured at forward and rearward interior walls of the housing and extend substantially the full length thereof.

5. The magazine of claim 4, wherein the follower is configured to move along the guides to a position substantially completely within the neck portion of the housing.

6. The magazine of claim 1, wherein the housing includes a forwardly sloped rear wall surface adjacent the mouth configured to contact a cartridge rim and advance an uppermost cartridge in a forward direction relative to the rim of a cartridge immediately there-below which is held in place by the second channel portion.

* * * * *